United States Patent [19]

Hoey et al.

[11] 4,095,505

[45] Jun. 20, 1978

[54] DRUM SNARE

[75] Inventors: Fred A. Hoey, San Antonio, Tex.; Robert A. Allmansberger, Bridgewater, N.J.

[73] Assignee: National Musical String Company, New Brunswick, N.J.

[21] Appl. No.: 765,852

[22] Filed: Feb. 4, 1977

[51] Int. Cl.[2] ..... G10D 13/02

[52] U.S. Cl. ..... 84/416; 84/452 P

[58] Field of Search ..... 84/415, 416, 417, 452, 84/453

[56] References Cited

PUBLICATIONS

"The Music Trades," Sep. 1964, p. 49.

*Primary Examiner*—Lawrence R. Franklin

*Attorney, Agent, or Firm*—McCormick, Paulding & Huber

[57] ABSTRACT

A snare for a musical drum is comprised of a set of molded plastic cords having integrally molded enlargements or nodules evenly spaced along the length of each cord. The cords are attached to metal or plastic end pieces, and in the case of plastic end pieces the end pieces and cords may all be molded as a single one-piece unit.

9 Claims, 5 Drawing Figures

FIG. 1
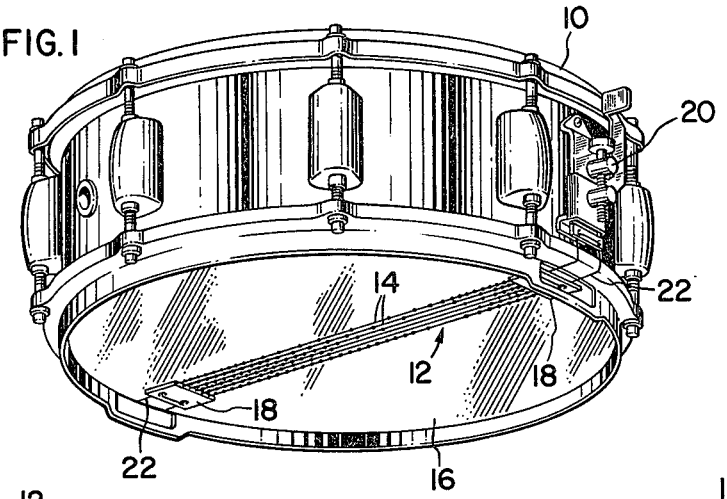
FIG. 2
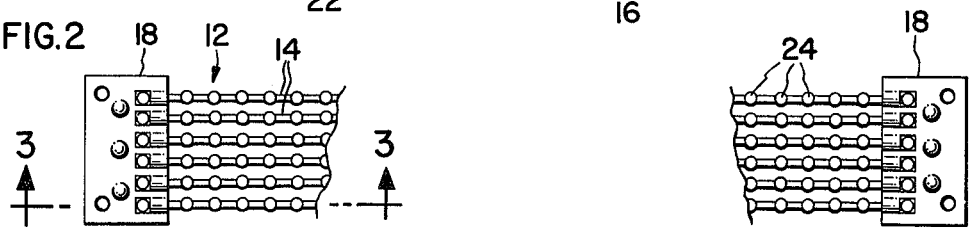
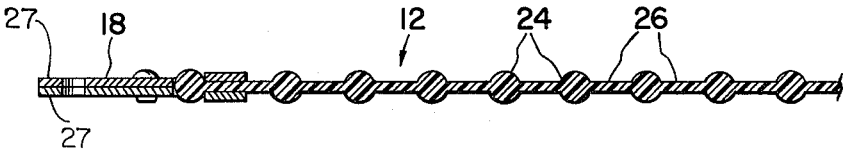
FIG. 3
FIG. 4
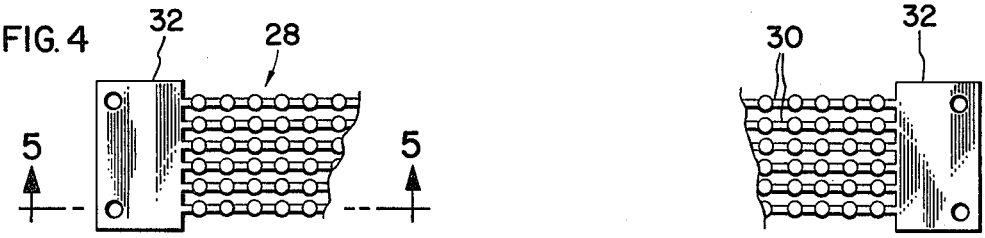
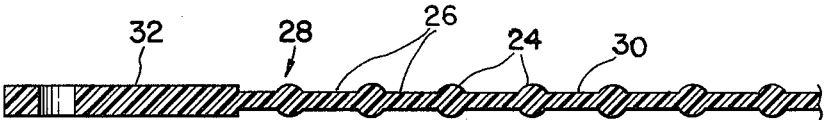
FIG. 5

DRUM SNARE

BACKGROUND OF THE INVENTION

This invention relates to musical instruments, and deals more particularly with improvements in the construction of snares for use with drums.

The general object of this invention is to provide a drum snare having desirable response and tonal effect when used with a drum and which nevertheless may be made at relatively low unit cost through the use of plastic molding techniques.

A further object of the invention is to provide a drum snare of the foregoing character and consisting of a set of cords attached to opposite end pieces adapted for use with conventional strainers and butts and wherein the cords and end pieces may all be made as a single one-piece molded plastic unit, if desired.

Other objects and advantages of the invention will be apparent from the drawings and from the description forming a part hereof.

SUMMARY OF THE INVENTION

The invention resides in a drum snare consisting of at least one cord made of a single piece of plastic and having a plurality of reduced diameter portions and a plurality of enlarged diameter portions with the reduced diameter portions alternating with the enlarged diameter portions so as to space the enlarged diameter portions from one another along the length of the cord.

The invention further resides in the snare consisting of a set of such one-piece plastic cords arranged parallel to one another and attached to end pieces at the opposite ends of the set. A still more specific aspect of the invention resides in the end pieces being made of the same plastic material as the cords and in the cords and the end pieces all being molded integrally with one another as a one-piece unit.

BRIEF DESCRIPTION OF THE DRAWINGS

FIG. 1 is a perspective view of a snare drum equipped with a snare embodying the present invention.

FIG. 2 is an enlarged plan view of the snare of FIG. 1.

FIG. 3 is a sectional view, on a still further enlarged scale, taken on the line 3—3 of FIG. 2.

FIG. 4 is a view similar to FIG. 2 but shows an alternative embodiment of the invention.

FIG. 5 is a view taken on the line 5—5 of FIG. 4 and drawn to a scale enlarged from that of FIG. 4.

DESCRIPTION OF THE PREFERRED EMBODIMENTS

FIG. 1 shows a snare drum 10 equipped with a snare 12 embodying the present invention. Basically, the snare comprises at least one cord 14, and preferably as shown a plurality of such cords, located adjacent the bottom drum head 16.

The means for attaching the snare cords 14, 14 to the drum may vary widely without departing from the invention. In FIG. 1, for example, the snare includes two end pieces 18, 18. The right-hand end piece is attached to a conventional strainer 20 by a cord 22, and the left-hand end piece is attached by another cord 22 to a conventional butt attached to the drum shell diametrically opposite from the strainer and not visible in FIG. 1.

Turning to FIGS. 2 and 3, each cord 14 of the snare 12 is made as a one-piece molded plastic part and is shaped to provide a series of beads or nodules 24, 24 spaced evenly along the length of the cord. That is, the beads or nodules 24, 24 are enlarged diameter portions of the cord which alternate lengthwise of the cord with a series of reduced diameter portions 26, 26. The portions 24 and 26 may take various different shapes, but preferably and as shown, the portions 24, 24 are of a generally spherical shape and the portions 26, 26 of a generally cylindrical shape.

The cords 14, 14 of the snare 12 are separate from one another and are fixed to the end pieces 18, 18 so as to be held by the latter in spaced parallel relationship to one another in a common plane. The design of the end pieces may vary widely, but in the illustrated case each is shown to consist of two metal plates 27, 27 riveted to one another and provided with suitable apertures and bends for accommodating the ends of the cords. Of course, it will be understood that the cords 14, 14 need not be assembled with end pieces in all cases and that they may instead be made and sold individually without end pieces for direct attachment to strainers and butts or other attachment means designed for such individual cords.

Also, instead of the cords 14, 14 of the snare being made separate from one another and attached to separate end pieces, the end pieces may be made of the same plastic material as the cords and molded integrally with the cords so that the cords and end pieces together comprise a single one-piece unit molded in one operation. Such a snare is shown at 28 in FIGS. 4 and 5. As shown, it consists of a set of cords 30, 30, similar to the cords 14, 14 of the snare 12, and two end pieces 32, 32 each molded integrally with the cords.

Any suitable moldable plastic, such as nylon, may be used to mold the cords 14, 14 of the snare 12 or the cords 30, 30 and end pieces 32, 32 of the snare 28. And, of course, the snares may be made in various different lengths to fit various different standard drum sizes and the number of cords in each snare may be varied to provide different degrees of soung attenuation and different tonal effects.

We claim:

1. A drum snare comprising at least one cord consisting of a single piece of plastic material, said cord along its length having a plurality of enlarged diameter portions and a plurality of reduced diameter portions, said enlarged diameter portions alternating with said reduced diameter portions so as to space said enlarged diameter portions from one another along the length of said cord.

2. A drum snare as defined in claim 1 further characterized by each of said reduced diameter portions of said cord being generally cylindrical in shape and by each of said enlarged diameter portions of said cord being generally nodular in shape.

3. A drum snare as defined in claim 1 further characterized by each of said reduced diameter portions of said cord being generally cylindrical in shape and by each of said enlarged diameter portions of said cord being generally spherical in shape.

4. A drum snare as defined in claim 1 further characterized by said cord having been made by molding the plastic material of which it is made into the shape of said cord.

5. A drum snare comprising a set of cords arranged in spaced parallel relationship to one another in a common plane, each of said cords of said set consisting of a single piece of plastic material and each of said cords along its length having a plurality of enlarged diameter portions and a plurality of reduced diameter portions, said enlarged diameter portions alternating with said reduced diameter portions so as to space said enlarged diameter portions from one another along the length of said cord.

6. A drum snare as defined in claim 5 further characterized by two end pieces located at opposite ends of said set of cords and to which said cords are attached for holding them in said spaced parallel relationship.

7. A drum snare as defined in claim 6 further characterized by said two end pieces being separate from one another and from said cords, and said cords being separate from one another and individually attached to said end pieces.

8. A drum snare as defined in claim 6 further characterized by each of said end pieces being made of the same plastic material as said cords, said two end pieces and all of said cords being integral with one another and consisting of a single piece of plastic material.

9. A drum snare as defined in claim 8 further characterized by said two end pieces and said cords having been made by molding the plastic material of which said end pieces and cords are made into the shape of said end pieces and cords.

* * * * *